US009655384B2

(12) United States Patent
Roscoe

(10) Patent No.: US 9,655,384 B2
(45) Date of Patent: May 23, 2017

(54) ARTICLE OF APPAREL WITH ENHANCED MOBILITY PORTIONS

(71) Applicant: NIKE, Inc., Beaverton, OR (US)

(72) Inventor: Justin Roscoe, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 198 days.

(21) Appl. No.: 14/622,971

(22) Filed: Feb. 16, 2015

(65) Prior Publication Data

US 2016/0235126 A1 Aug. 18, 2016

(51) Int. Cl.

| | |
|---|---|
| ***A41B 1/08*** | (2006.01) |
| ***A41D 31/00*** | (2006.01) |
| ***A41D 1/04*** | (2006.01) |
| ***A41D 13/00*** | (2006.01) |

(52) U.S. Cl.

CPC ..... *A41B 1/08* (2013.01); *A41D 1/04* (2013.01); *A41D 13/0015* (2013.01); *A41D 31/0005* (2013.01); *A41D 2600/10* (2013.01)

(58) Field of Classification Search

CPC ..... A41D 27/08; A41D 13/0015; A41D 3/00; A41D 1/04; A41B 1/00

USPC ..... 2/243.1, 69, 115, 108, 102, 92; 482/105, 482/121

See application file for complete search history.

(56) References Cited

U.S. PATENT DOCUMENTS 1,707,441 A * 4/1929 Levinson ..... A41D 1/04 2/90
2,554,361 A * 5/1951 Ettien ..... A41D 1/00 2/105
3,098,236 A * 7/1963 Bernfeld ..... A41D 1/18 2/106
3,137,860 A * 6/1964 Bindler ..... A41D 27/10 2/115
3,246,337 A * 4/1966 Copeland ..... B63C 11/02 2/2.15
5,201,074 A * 4/1993 Dicker ..... A41D 13/0015 2/227
5,210,877 A * 5/1993 Newman ..... A41D 1/067 2/115
5,367,708 A * 11/1994 Fujimoto ..... A41D 13/0015 2/22
6,047,406 A * 4/2000 Dicker ..... A41D 13/0015 2/115

(Continued)

FOREIGN PATENT DOCUMENTS

JP 2012052265 A 3/2012

OTHER PUBLICATIONS

International Search Report and Written Opinion Dated Jul. 4, 2016 for International Patent Application No. PCT/US2016/018052, 20 pages.

*Primary Examiner* — Tejash Patel
(74) *Attorney, Agent, or Firm* — Shook, Hardy & Bacon L.L.P.

(57) ABSTRACT

An article of apparel having enhanced mobility portions is provided herein for an upper torso of a wearer. The article of apparel may comprise a front panel affixed to a back panel. The back panel comprises a first portion having a first lateral stretch characteristic, where the first portion is located along an upper part of the back panel. The back panel may further comprise a second portion located adjacent to and below the first portion. The second portion has a second stretch characteristic that less than the first stretch characteristic.

16 Claims, 7 Drawing Sheets

(56) References Cited

U.S. PATENT DOCUMENTS

| | | | | |
|---|---|---|---|---|
| 8,856,964 | B2 * | 10/2014 | Mather | A41D 1/04 2/115 |
| 9,119,707 | B2 * | 9/2015 | Brown | A41D 13/0015 |
| 2008/0134409 | A1 | 6/2008 | Karasina | |
| 2009/0077708 | A1 | 3/2009 | Takamato et al. | |
| 2013/0227758 | A1 | 9/2013 | Doney | |

* cited by examiner

ARTICLE OF APPAREL WITH ENHANCED MOBILITY PORTIONS

FIELD

The present disclosure relates to an article of apparel having enhanced mobility portions and reinforcement portions. More particularly, the present disclosure relates to a top having at least a front panel and a back panel, where the back panel comprises a first portion having a lateral stretch characteristic that is greater than a second portion of the back panel. Moreover, the top described herein comprises one or more reinforcement portions located in those areas of the top that are particularly prone to wear-and-tear.

BACKGROUND

Some sports or activities require a person to repetitively reach forward with the person's arms and/or to reach forward and down in an attempt to pick up or touch something at or near the ground. Exemplary sports that have this type of movement include, for example, road biking, mountain biking, climbing, kayaking, skateboarding, and the like. Using skateboarding as an example, skateboarders are constantly reaching down to touch or pick up their skateboards. Typical tops or sweatshirts worn by these athletes are not designed for this type of constant repetitive motion. For example, a typical top has a back panel that is comprised generally of a single type of material that has a uniform degree of stretch. The action created by reaching forward and/or reaching down generally results in a large amount of lateral stretch force being applied to the upper back area of the top. By contrast, this type of movement generally does not produce significant amounts of lateral stretch force at the lower part of the top. Because the lateral stretch force is being unevenly applied to the back panel, the result is that the upper back area of the top gradually deforms or gets "pulled out of shape" while the lower part of the top retains its general shape. This not only distorts the appearance of the top but shortens its useful life.

Again using skateboarding as an example, participants of this sport generally experience a large number of falls with the skateboarders landing on their bottom or lower back and often striking or scraping their elbow or forearm area on a hard surface such as concrete or asphalt. Typical tops worn by skateboarders often rip, tear, or wear out in these areas again shortening the life of this apparel item.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed towards an article of apparel having enhanced mobility portions and reinforcement portions. In exemplary aspects, the article of apparel may comprise a top having a front panel affixed to a back panel. The back panel may have a first portion that has a lateral stretch characteristic that is greater than a second portion of the back panel. Moreover, the first portion is located generally along the upper portion of the back panel such that it overlays the upper back area of a wearer when the top is worn. By configuring the back panel as described, the large amounts of lateral stretch force generated along the upper portion of the wearer's back when, for example, the wearer reaches his/her arms forward and/or down are accommodated by the first portion of the back panel. When the wearer returns to a resting or upright position with the wearer's arms at or near the wearer's side, the first portion of the back panel reverts to its resting state. The result is that the top maintains its shape during repetitive use.

Besides the enhanced mobility portions, the article of apparel described herein may further comprise one or more reinforcement portions located on the article at areas subject to high wear-and-tear. As mentioned above, athletes in some sports, such as skateboarding, experience a large number of falls on hard surfaces. These types of athletes typically fall on their lower back or bottom area, and their elbows and/or forearms frequently strike the ground during the fall. To create padding as well as to provide reinforcement in these areas, the article described herein may further comprise multiple layers of material along the lower portion of the back panel as well as along the elbow and forearm areas of the sleeves. Other portions of the top may be formed from a single layer of material to minimize the weight of the top.

Aspects herein may further relate to a method of manufacturing an article of apparel having enhanced mobility portions. The method may comprise the steps of preparing a front panel of the article of apparel where the front panel is adapted to cover a front portion of an upper torso of a wearer when the article of apparel is worn. A back panel of the article of apparel is also prepared, where the back panel is adapted to cover a back portion of the upper torso of the wearer when the article of apparel is worn. The back panel may comprise a first portion having a first lateral stretch characteristic that is positioned along an upper part of the back panel. The back panel further comprises a second portion having a second lateral stretch characteristic that is less than the first lateral stretch characteristic. The second portion is located adjacent to and below the first portion of the back panel. The method may further comprise the step of affixing the front panel to the back panel along at least a first side and a second side to form the article of apparel.

BRIEF DESCRIPTION OF THE DRAWINGS

Examples of the present invention are described in detail below with reference to the attached drawing figures, wherein.

DETAILED DESCRIPTION

Figure 1:
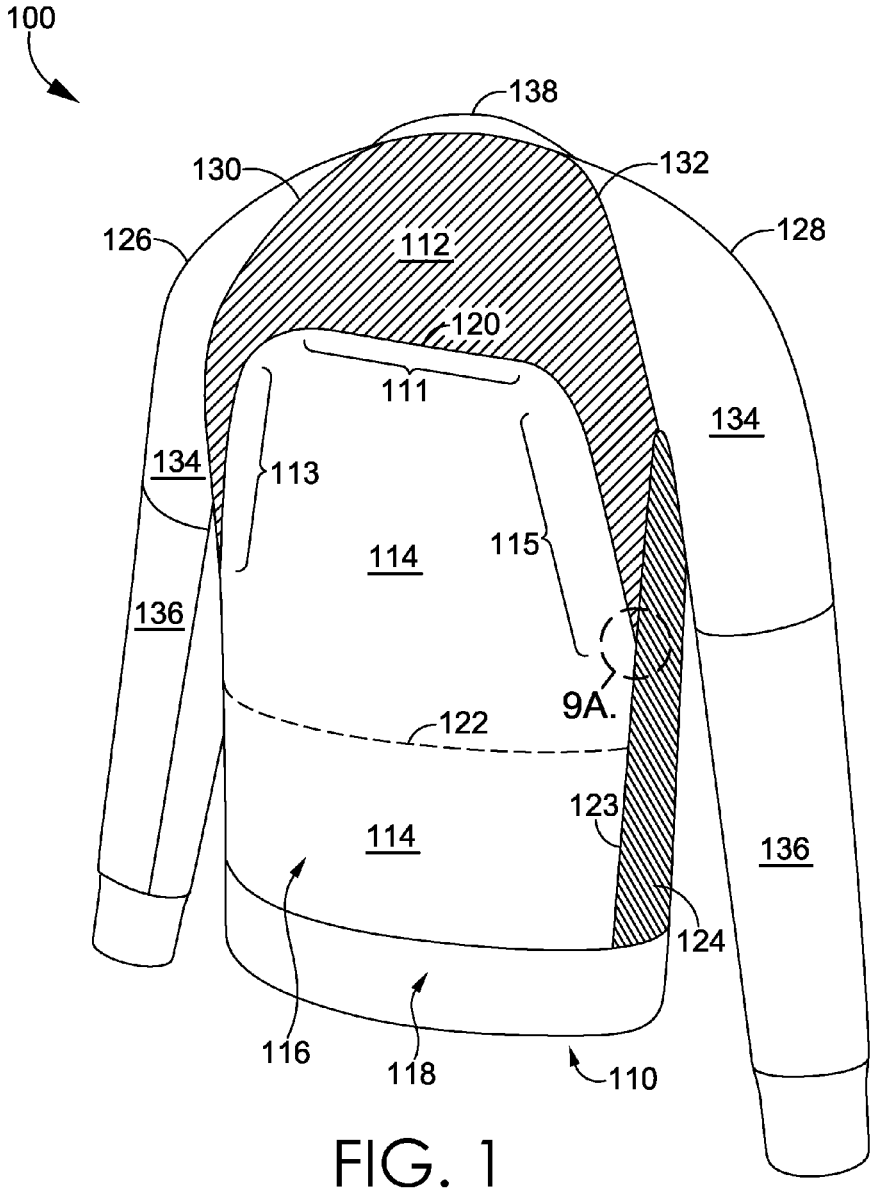
FIG. 1 illustrates a back perspective view of an exemplary article of apparel having enhanced mobility portions and reinforcement portions in accordance with an aspect herein.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein relate to an article of apparel such as a top having enhanced mobility portions and, optionally, one or more reinforcement portions. The enhanced mobility portions may be positioned along an upper portion of a back panel of the top such that they generally overlay the upper back area of the wearer when the top is being worn. Enhanced mobility portions located in this area may have a lateral stretch characteristic that is greater than other portions of the top. The increased lateral stretch characteristic of the mobility portions may be due to the type of material used to construct the mobility portions and/or it may be due to the particular structure of the material. As an example, the mobility portions may comprise a ribbed knit that has vertically-oriented ribbing. When a lateral or horizontal stretch force is applied to the mobility portions located along the upper portion of the back panel such as when a wearer reaches his/her arms forward and/or downward, the ribs are pulled apart in a horizontal direction providing "give" to the upper portion of the back panel. Conversely, when the lateral stretch force is no longer being applied to the mobility portions, the ribs move back together thereby retaining the shape integrity of the article of apparel. The lateral stretch force applied to the article may be augmented when portions of the article of apparel are fixed in position with relationship to the wearer. For instance, the lateral stretch force may be augmented when the article of apparel includes thumbholes located at the ends of the sleeves and the wearer positions her thumbs in the thumbhole. This effectively locks the sleeves into place such that they cannot slide up the wearer's arms. Thus, when the wearer stretches her arms forward and/or downward, the lateral stretch force across the upper back portion of the article of apparel is increased.

The article of apparel may further comprise enhanced mobility portions located along the sides of the back panel such that they overlay the sides of the wearer when the top is being worn. Mobility portions located in this area may have a higher vertical stretch characteristic as opposed to other portions of the back panel. When a vertical stretch force is applied to mobility portions located on the sides of the back panel—as may occur, for example, when the wearer raises his/her arms above the wearer's head—the side panels accommodate the vertical stretch force. When the vertical stretch force is no longer being applied to the side mobility panels, the side panels return to their resting state and the shape integrity of the top is maintained.

The article of apparel may further comprise one or more reinforcement portions that have two or more layers of material as opposed to a single layer. The reinforcement portions are located in areas prone to high amounts of wear-and-tear. For example, the reinforcement portions may be located along a lower back portion of the back panel. As well, they may be located along the elbow area and forearm arm area of the sleeves.

Turning now to FIG. 1, FIG. 1 illustrates a back perspective view of an article of apparel 100 having enhanced mobility portions and reinforcement portions in accordance with an aspect herein. More particularly, the article of apparel 100 comprises a back panel 110 that comprises a first portion 112 (indicated by hash marks) and a second portion 114. The back panel 110 may further optionally comprise a first sleeve 126, a second sleeve 128, a waistband 118, a neckband 138, and side panels 124 (only one of which is shown in FIG. 1). The article of apparel 100 may comprise a shirt or top such as, for example, a T-shirt, a jersey, a sweatshirt and the like.

The first portion 112 of the back panel 110 is generally located along an upper part of the back panel 110 such that it overlays the upper back area of a wearer when the article of apparel 100 is worn. In one exemplary configuration, the first portion 112 may comprise a central body portion 111, a first arm 113, and a second arm 115. The central body portion 111 may generally occupy the upper one-eighth, one-fourth, or one-third of the back panel 110 although it may occupy up to one-half of the back panel 110. The first arm 113 generally begins at a location adjacent to a lower margin of the arm opening for the first sleeve 126 and extends up to the central body portion 111 Likewise, the second arm 115 generally begins at a location adjacent to a lower margin of the arm opening for the second sleeve 128 and extends up to the central body portion 111. Although the first portion 112 is described as having the central body portion 111 and the first and second arms 113 and 115, it is contemplated herein that the first portion 112 may comprise a single construction. Alternatively, the central body portion 111, the first arm 113, and the second arm 115 may be constructed from separate pieces of material that are affixed together at one or more seams to form the first portion 111. Any and all such aspects, and any variation thereof, are contemplated as being within the scope herein.

Figure 10:
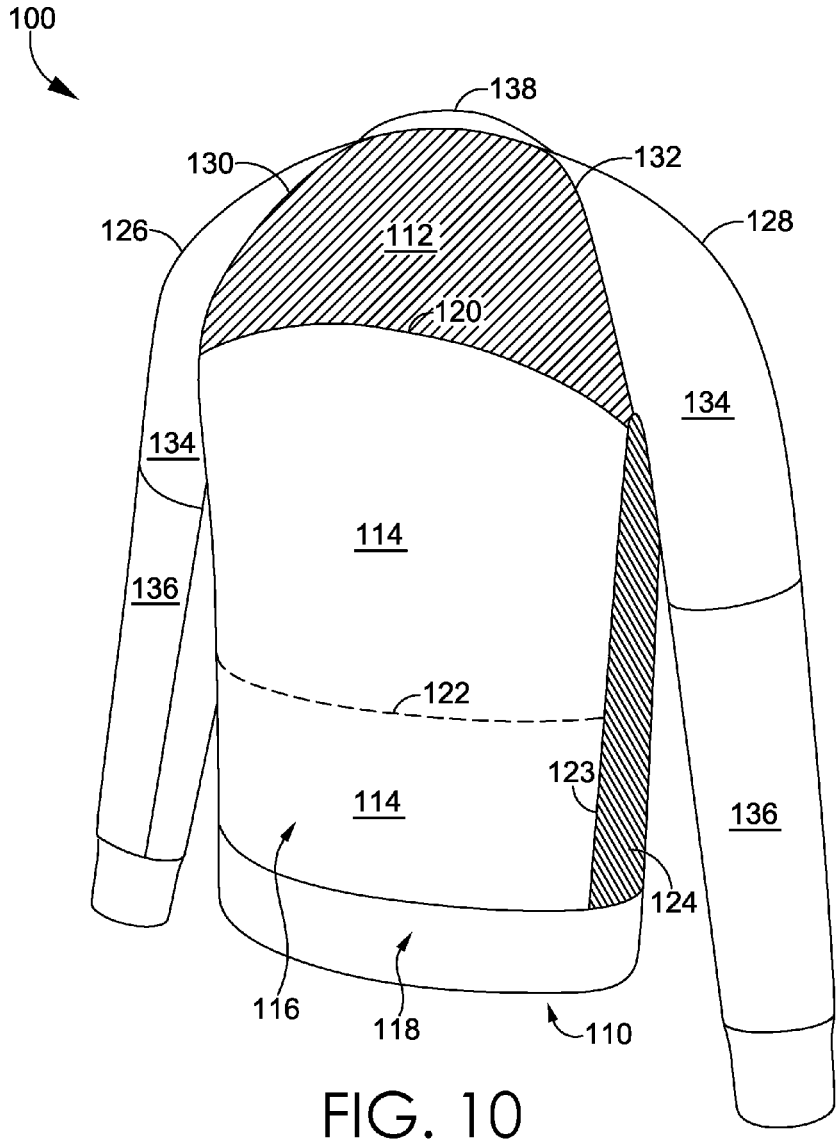
FIG. 10 illustrates a back perspective view of an exemplary article of apparel having enhanced mobility portions and reinforcement portions in accordance with an aspect herein.

FIG. 10 illustrates another exemplary configuration of the first portion 112 of the back panel 110 in accordance with aspects herein. Similar to that shown in FIG. 1, the first portion 112 generally occupies the upper portion of the back panel 110. However, instead of having distinct arms such as the first arm 113 and the second arm 115, the first portion 112 may have a central body portion that tapers downward slightly at the sides of the article of apparel 100. Any and all such aspects, and any variation thereof, are contemplated as being within the scope herein.

Returning now to FIG. 1, in one exemplary aspect, the first portion 112 of the back panel 110 may be formed from a separate panel of material that may be joined to the second portion 114 at a seam 120. When the article of apparel 100 further comprises the first sleeve 126 and the second sleeve 128, the first portion 112 may be joined to the sleeves 126 and 128 at seams 130 and 132 respectively.

The material used to form the first portion 112 may comprise a material that has a high lateral stretch characteristic. As used throughout this disclosure, the term "lateral stretch characteristic" may be defined as the ability of a material to stretch in a horizontal or lateral direction and return to its resting or non-stretched state. One exemplary material used to form the first portion 112 may comprise, for instance, a ribbed knit where the ribs are oriented in a vertical direction. The ribbed knit may be used by itself to form the first portion 112 or it may be combined with other materials to form a composite layer. For example, a mesh or wicking material may underlay and/or overlay the ribbed knit to impart breathability or wicking characteristics to the first portion 112. Other materials contemplated herein to form the first portion 112 may comprise stretch fabrics that incorporate spandex fibers, elastane fibers, and the like. For instance, a Tri-blend material incorporating cotton, polyester, and rayon may be used to form the first portion 112. In an exemplary aspect, the first portion 112 may comprise a single layer of material.

In another exemplary aspect, the first portion 112 may be integrally knit with the second portion 114 to form the back panel 110. For example, the back panel 110 may comprise an engineered knit and instead of the reference numeral 120 indicating a seam, the numeral 120 may indicate a transition from the first portion 112 that is knit to have a first lateral stretch characteristic to the second portion 114 that is knit to have a second lateral stretch characteristic that is less than the first stretch characteristic. Any and all such aspects, and any variation thereof, are contemplated as being within the scope herein.

As shown in FIG. 1, the second portion 114 lies adjacent to and below the first portion 112 such that it overlays the middle and lower back areas of the wearer when the article of apparel 100 is worn. The second portion 114 may be affixed to the waistband 118 at its lower margin. In one aspect, the second portion 114 may be constructed from a separate panel of material that is affixed to the first portion 112 at the seam 120. The material used to construct the second portion 114 is selected to have a lower lateral stretch characteristic as compared to the first portion 112. An exemplary material used to form the second portion 114 may comprise a French terry material although other types of materials are contemplated herein such as, for example, a cotton/polyester blend.

In another aspect the second portion 114 may be integrally knit with the first portion 112, and the reference numeral 120 may indicate the area of transition from the second portion 114 having the lower lateral stretch characteristic to the first portion 112 having the higher lateral stretch characteristic.

The second portion 114 may comprise a reinforcement portion 116 that is located near the lower margin of the back panel 110. As mentioned above, this area may be especially prone to wear-and-tear in certain sports. The reinforcement portion 116 may comprise two or more layers of material while the remaining part of the second portion 114 may comprise a single layer of material. The transition from the multiple layers of the reinforcement portion 116 to the single-layer of the remainder of the second portion 114 is indicated by the dashed line 122.

The back panel 110 may optionally comprise two enhanced mobility side portions or panels 124, only one of which is shown using cross-hatching due to the perspective view of FIG. 1. The side panels 124 generally begin at the lower margins of the sleeve openings for the first and second sleeves 126 and 128, extend along the lateral sides of the back panel 110, and terminate at the waistband 118. The upper ends of the side panels 124 may be adjacent to the first and second arms 113 and 115 of the first enhanced mobility portion 112. In aspects, the side panels 124 may comprise separate panels of material that are affixed to the first and second portions 112 and 114 by seams 123. In other aspects, the side panels 124 may be integrally knit with the first and second portions 112 and 114, and the transition from the first and second portions 112 and 114 to the side panels 124 may be indicated by the numeral 123.

The side panels 124 may be enhanced mobility portions in that they may have a vertical stretch characteristic that is greater than the first portion 112 and/or the second portion 114. As used throughout this disclosure, the term "vertical stretch characteristic" may be defined as the ability of a material to stretch in a vertical direction when a vertical stretch force is applied to the article of apparel 100 and to subsequently return to its resting or non-stretched state when the force is no longer applied. Having a higher vertical stretch characteristic at the side panels 124 may be advantageous when a wearer repetitively raises his/her arms above the wearer's head. This action generally imposes a vertical stretch force along the sides of the article of apparel 100. This force is particularly enhanced when, for example, the waistband 118 of the article 100 is fixed such as, for example, when the waistband 118 is tucked into a pair of pants or shorts. The force may also be enhanced when the article of apparel 100 includes thumbholes and the wearer positions his thumbs in the thumbholes and then raises his arms in an upward direction. By configuring the article of apparel 100 to have side panels 124 capable of dissipating a vertical stretch force, the shape integrity of the article 100 is further maintained and the life of the article 100 is prolonged.

The vertical stretch characteristic of the side panels 124 may be due to the type of material used to construct the side panels 124 and/or due to the structure of the material. For example, the side panels 124 may be formed used a single-layered ribbed knit similar to the ribbed knit used to form the first portion 112. However, instead of orienting the ribs in a vertical direction like in the first portion 112, the ribs may be oriented in a horizontal direction to better accommodate a vertical stretch force. The vertical stretch characteristic of the side panels 124 may also be created by using materials that incorporate spandex fibers, elastane fibers, and/or other type of stretch fibers such as, for example, a Tri-blend that incorporates cotton, polyester, and rayon fibers.

The optional sleeves 126 and 128 of the article of apparel 100 may comprise one or more reinforcement portions. Using the sleeve 128 as a representative example, the sleeve 128 may comprise an upper or shoulder portion 134 that is affixed to the back panel 110 at seam 132, and a lower portion 136 configured to cover the wearer's elbows area and forearm area when the article 100 is being worn. The lower portion 136 may be formed from two or more layers of material to provide reinforcement and added padding to this area. Conversely, the upper or shoulder portion 134 may be formed from a single layer of material to reduce the overall weight of the article 100. In an exemplary aspect, the material used to form the upper and lower portions 134 and 136 of the sleeves 126 and 128 may be the same material as that used to form the second portion 114 of the back panel 110. An exemplary material may comprise French terry although other materials are contemplated herein such as, for example, a blend of cotton and polyester.

Figure 2:
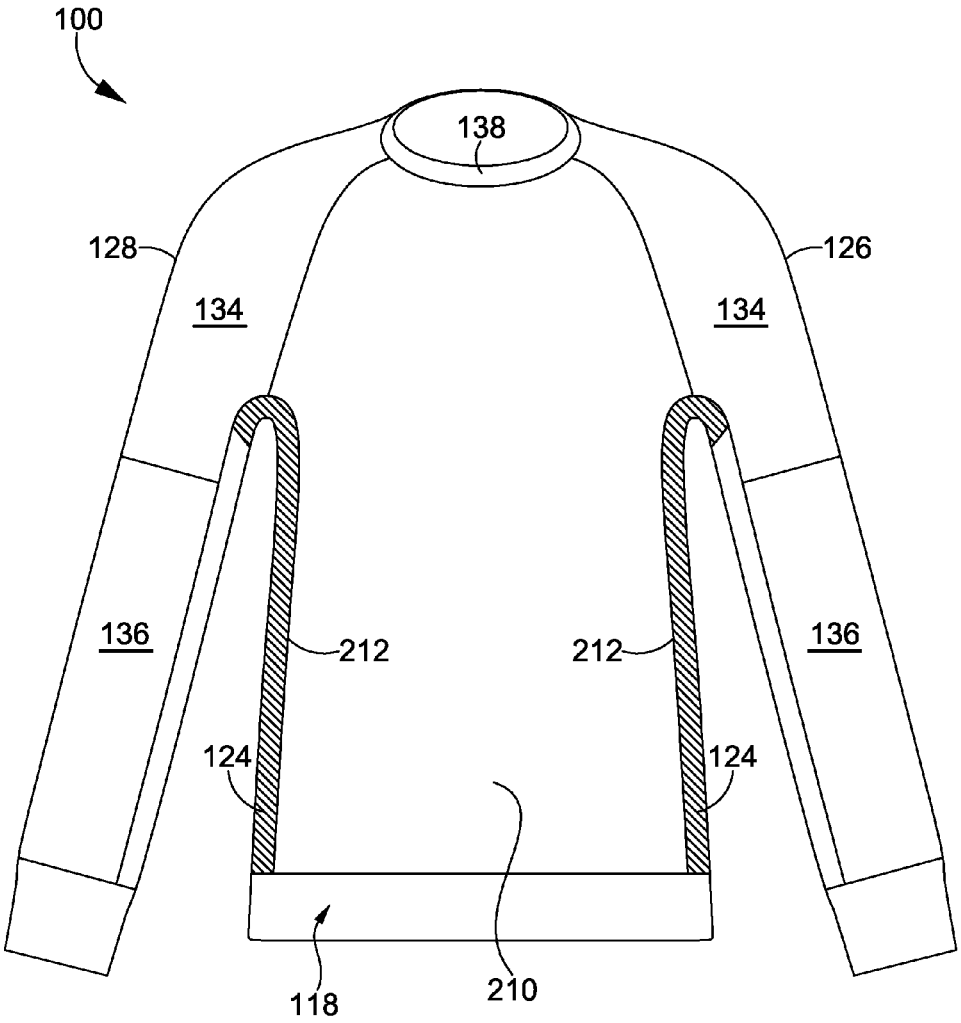
FIG. 2 illustrates a front elevation view of an exemplary article of apparel having enhanced mobility portions and reinforcement portions in accordance with an aspect herein.

With respect to FIG. 2, FIG. 2 illustrates a front elevation view of the exemplary article of apparel 100 in accordance with an aspect herein. FIG. 2 illustrates many of the same features as FIG. 1 such as the first sleeve 126 and the second sleeve 128 with their reinforcement portions 136, the neckband 138, the waistband 118, and the enhanced mobility side panels 124. FIG. 2 further illustrates a single-layered front panel 210 that is affixed to the back panel 110 along at least the sides of the article of apparel 100. Referring specifically to FIG. 2, the front panel 210 may be affixed to the back panel 110 via the side panels 124 at least at a seam 212. In another exemplary aspect, the side panels 124 may not be present, and the front panel 210 may be affixed directly to the back panel 110. In yet another exemplary aspect, the front panel 210 may be integrally knit from the back panel 110. Any and all such aspects, and any variation thereof, are contemplated as being within the scope herein. Moreover, the front panel 210 may be constructed from the same material as the second portion 114 of the back panel 110 such as, for example, French terry or other cotton/polyester blends, and the front panel 210 may have generally the same lateral stretch characteristic as the second portion 114 of the back panel 110.

Figure 3:
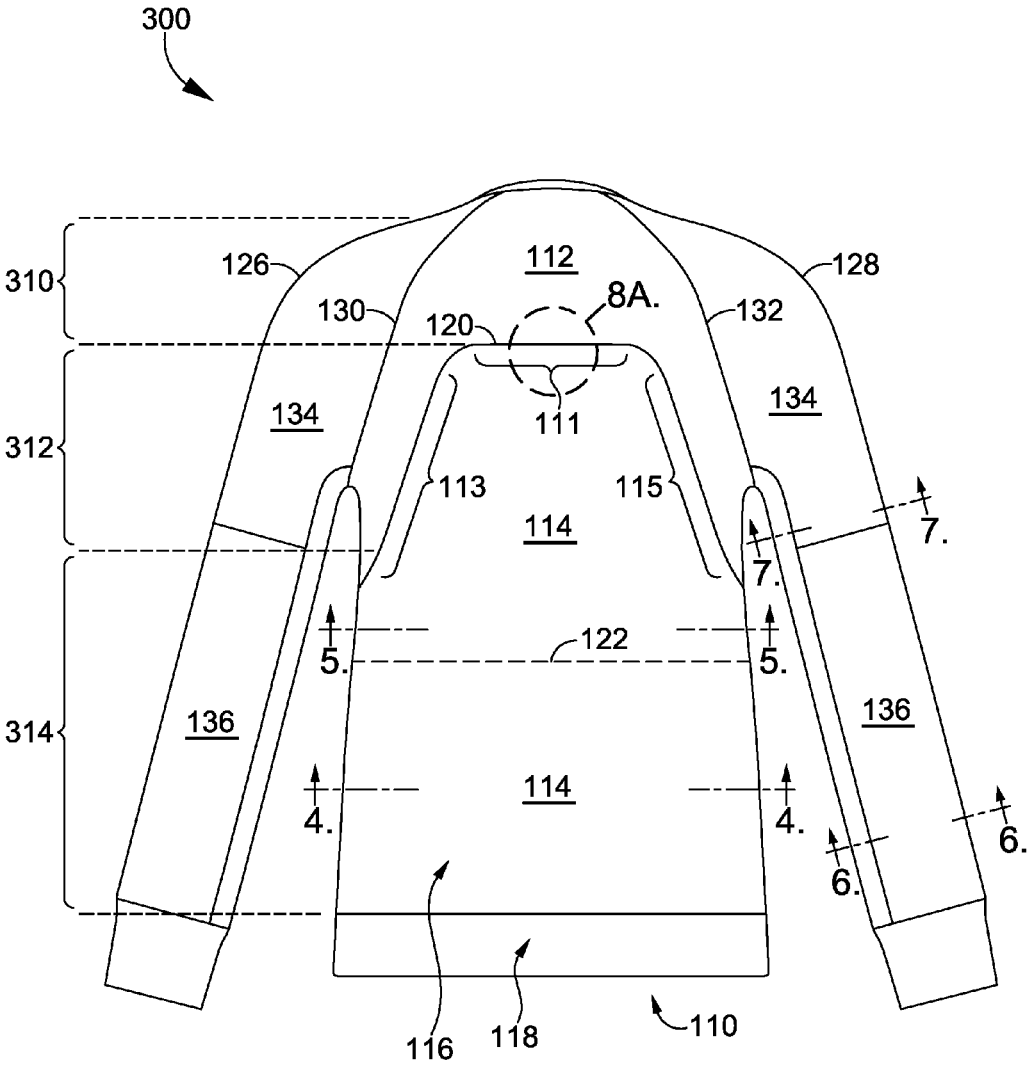
FIG. 3 illustrates a back elevation view of an exemplary article of apparel having enhanced mobility portions and reinforcement portions in accordance with an aspect herein.

FIG. 3 illustrates a back elevation view of an article of apparel 300 having enhanced mobility portions and reinforcement portions in accordance with an aspect herein. The article of apparel 300 is similar to the article of apparel 100, but it does not include the optional enhanced mobility side panels 124. The same reference numerals used to indicate the mobility portions and reinforcement portions of the article of apparel 100 are similarly used in FIG. 3 to indicate those same portions. FIG. 3 further depicts a series of cut lines denoting cross-sectional views shown in FIGS. 4-7 and a reference circle denoting a close-up view shown in FIGS. 8A and 8B.

With respect to FIG. 3, the back panel 110 of the article of apparel 300 may be subdivided into a series of stretch zones 310, 312, and 314. The first stretch zone 310 generally comprises that area of the back panel 110 occupied by the central body portion 111 of the first portion 112. While the second stretch zone 312 generally comprises that area of the back panel 110 occupied by the first arm 113 and the second arm 115 of the first portion 112, and that part of the second portion 114 that is located between the first and second arms 113 and 115. The overall lateral stretch characteristic of the second stretch zone 312 may be less than the overall lateral stretch characteristic of the first stretch zone 310. This is because the second stretch zone 312 comprises portions having a greater lateral stretch characteristic (e.g., the first and second arms 111 and 113 of the first portion 112) and portions having a lesser lateral stretch characteristic (e.g., the second portion 114), while the first stretch zone 310 comprises just those portions having the greater lateral stretch characteristic.

Continuing, the third stretch zone 314 generally comprises that area of the back panel 110 occupied by just the second portion 114. Because the second portion 114 has a lesser lateral stretch characteristic than the first portion 112, the third stretch zone 314 may have an overall lateral stretch characteristic that is less than both the first stretch zone 310 and the second stretch zone 312. Thus, to summarize, the first stretch zone 310 may generally have the highest lateral stretch characteristic, the third stretch zone 314 may generally have the lowest overall lateral stretch characteristic, and the second stretch zone 312 may have an overall lateral stretch characteristic that is between the first stretch zone 310 and the third stretch zone 314.

The configuration of the different stretch zones 310, 312, and 314 corresponds generally to the amount of lateral stretch force imposed on the article of apparel 300 when a wearer reaches his/her arms forward and/or leans down to the ground to touch or pick up something. In other words, the action of reaching forward and/or towards the ground imposes the greatest lateral stretch force on the upper back area corresponding to the first stretch zone 310. But this action also imposes a moderate degree of lateral stretch force over the mid-back area of the back panel 110, which corresponds to the second stretch zone 312. The reaching action generally imposes the least amount of lateral stretch force to the lower part of the article 300 corresponding to the third stretch zone 314. So the configuration of the different stretch zones 310, 312, and 314 contributes to the ability of the article of apparel 300 to retain its shape integrity for a prolonged period of time.

Figure 4:
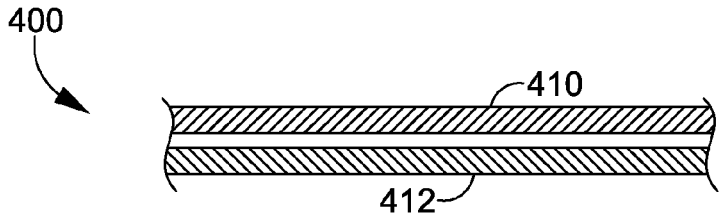
FIG. 4 depicts a cross-section taken along cut line 4-4 of FIG. 3 and illustrates a reinforcement portion along a lower back portion of the exemplary article of apparel in accordance with an aspect herein.

Turning now to FIG. 4, FIG. 4 illustrates a cross-sectional view 400 taken along cut line 4-4 of FIG. 3 in accordance with an aspect herein. The cross-sectional view 400 illustrates the double-layer construction of the reinforcement portion 116. More specifically, the view 400 depicts a first layer 410 and a second layer 412. The first and second layers 410 and 412 may be constructed from the same materials, or the layers 410 and 412 may be constructed from different materials. Moreover, the layers 410 and 412 may be freely movable with respect to one another in one aspect, or the layers 410 and 412 may be loosely secured to each other using, for example, one or more tie yarns. As described, the use of multiple layers in this area of the article of apparel 300 provides for added padding and reinforcement in the event the wearer of the article 300 falls on his/her bottom or lower back.

Figure 5:
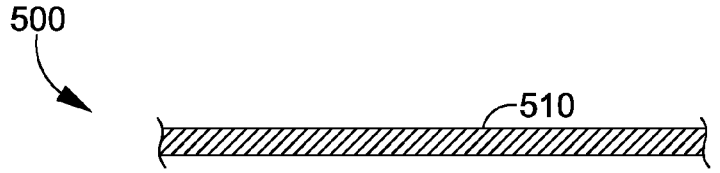
FIG. 5 depicts a cross-section taken along cut line 5-5 of FIG. 3 and illustrates a single-layer portion along a middle back portion of the exemplary article of apparel in accordance with an aspect herein.

Continuing, FIG. 5 illustrates a cross-sectional view 500 taken along cut line 5-5 of FIG. 3 in accordance with an aspect herein. The view 500 illustrates the single-layer construction of the remaining part of the second portion 114 (i.e., the area that does not include the reinforcement portion 116). More specifically, the view 500 illustrates a single layer of material 510.

Figure 6:
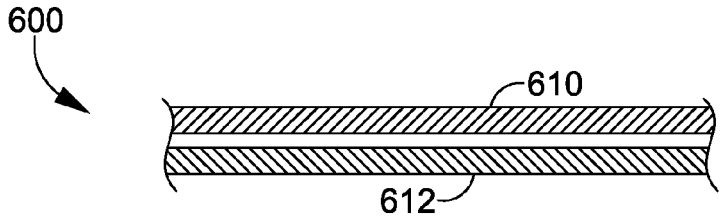
FIG. 6 depicts a cross-section taken along cut line 6-6 of FIG. 3 and illustrates a reinforcement portion along a lower arm portion of the exemplary article of apparel in accordance with an aspect herein.

FIG. 6 illustrates a cross-sectional view 600 taken along cut line 6-6 of FIG. 3 in accordance with an aspect herein. The view 600 illustrates the double-layer construction of the reinforcement portion 136 of the sleeves 126 and 128. More particularly, the view 600 illustrates a first layer 610 and a second layer 612. The layers 610 and 612 may be constructed from the same material or different materials. Similar to the layers 410 and 412, the layers 610 and 612 may be unaffixed to each other in one aspect, or the layers 610 and 612 may be loosely secured to one another using one or more tie yarns. The use of multiple layers in the forearm and elbow area of the sleeves 126 and 128 provides padding and reinforcement in the event the wearer of the article 300 strikes his/her lower arm area against the ground.

Figure 7:
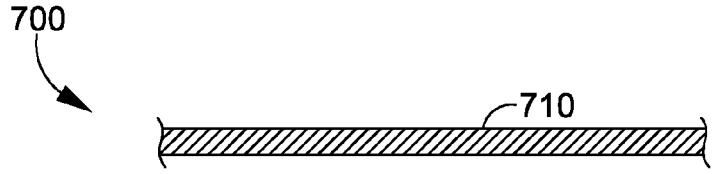
FIG. 7 depicts a cross-section taken along cut line 7-7 of FIG. 3 and illustrates a single-layer portion along an upper arm potion of the exemplary article of apparel in accordance with an aspect herein.

FIG. 7 illustrates a cross-sectional view 700 taken along cut line 7-7 of FIG. 3 in accordance with an aspect herein. The view 700 illustrates how the remaining portion of the sleeves (e.g., the upper portion 134) is comprised of a single layer of material 710. By minimizing the layers of materials in those areas of the article 300 that are not prone to high wear-and-tear, the weight of the article 300 can be minimized.

Figure 8A:
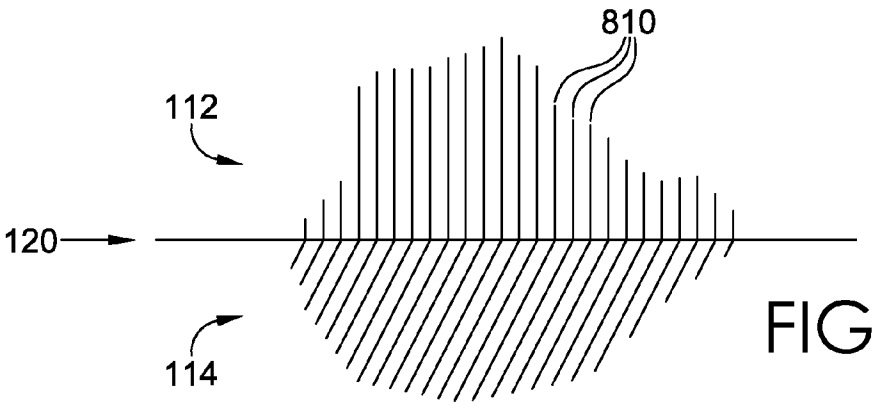
FIG. 8A illustrates a close-up view of an enhanced mobility portion of an exemplary article of apparel before a lateral stretch force has been applied in accordance with an aspect herein.
Figure 8B:
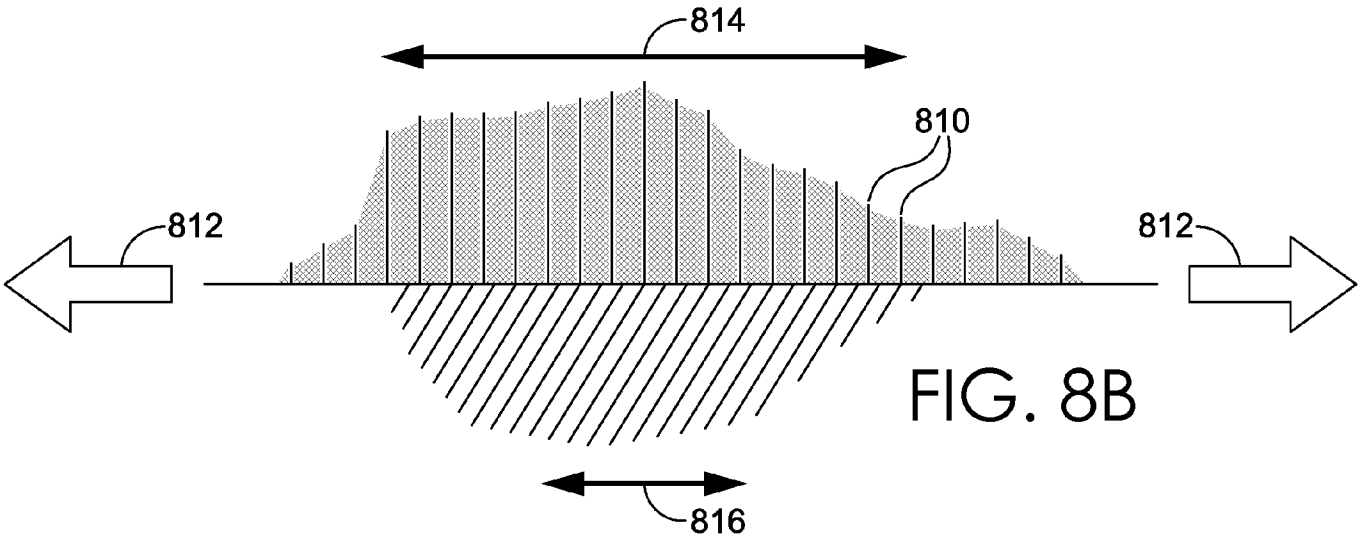
FIG. 8B illustrates a close-up view of the enhanced mobility portion of FIG. 8A as a lateral stretch force is being applied in accordance with an aspect herein.

FIGS. 8A and 8B are close-up views of the intersection of the first and second portions 112 and 114 at the area indicated by the reference circle shown in FIG. 3. FIGS. 8A and 8B illustrate the different lateral stretch characteristics of the first and second portions 112 and 114 of the back panel 110 when a lateral stretch force is applied to the article 300. Referring first to FIG. 8A, FIG. 8A illustrates the first portion 112 and the second portion 114 of the back panel 110 in a resting state (i.e., before or after a lateral stretch force has been applied to the article 300). The first portion 112 is shown as a ribbed knit with the ribs 810 oriented in a generally vertical direction. Although a ribbed knit is shown in FIG. 8A, it is contemplated that other materials having lateral stretch characteristics may be used (e.g., stretch fabrics incorporating spandex and/or elastane fibers such as a Tri-blend). As described above, the second portion 114 may be formed from a material such as French terry or a cotton/polyester blend. The first portion 112 is shown as separated from the second portion 114 by the seam 120. The seam 120 may be an actual seam, or in cases where the first and second portions 112 and 114 are integrally knit from each other, the seam 120 may indicate a transition point from the first lateral stretch characteristic of the first portion 112 to the second lateral stretch characteristic of the second portion 114.

FIG. 8B illustrates the first portion 112 and the second portion 114 as a lateral stretch force is applied to the article 300; the lateral stretch force is shown by the arrows 812. The lateral stretch force 812 may be applied, for instance, subsequent to a wearer of the article 300 reaching forward and/or downward to pick up something at or near the ground. This type of action by the wearer initiates the lateral stretch force 812 mainly along the upper back area of the wearer which is covered by the first portion 112. As shown in FIG. 8B, the lateral stretch force 812 causes the ribs 810 of the first portion 112 to pull apart or move in a horizontal direction thereby accommodating the lateral stretch force 812. The amount of lateral stretch experienced by the first portion 112 is shown graphically by the length of the arrow 814. In an exemplary aspect, the material between the ribs 810—indicated by the cross-hatching in FIG. 8B—may have a different color than the ribs 810 and/or the other portions of the article 300. The result is a color reveal in the first portion 112 when the lateral stretch force 812 is applied to the article 300.

Because of the location of the second portion 114 on the article of apparel 300, the second portion 114 generally does not experience as much of the lateral stretch force 812 as the first portion 112. Thus, the second portion 114 can be constructed of a material that has a lesser lateral stretch characteristic as compared to the first portion 112. As shown in FIG. 8B, when the lateral stretch force 812 is applied to the article 300, the second portion 114 does not undergo as much lateral stretch as the first portion 112. This is shown graphically by the length of the arrow 816 in FIG. 8B. The result of the configuration of the first and second portions 112 and 114 is that the lateral stretch force 812 is accommodated by the first portion 112, and the article of apparel 300 retains its shape integrity for a longer period of time as compared to more typical constructions.

Figure 9A:
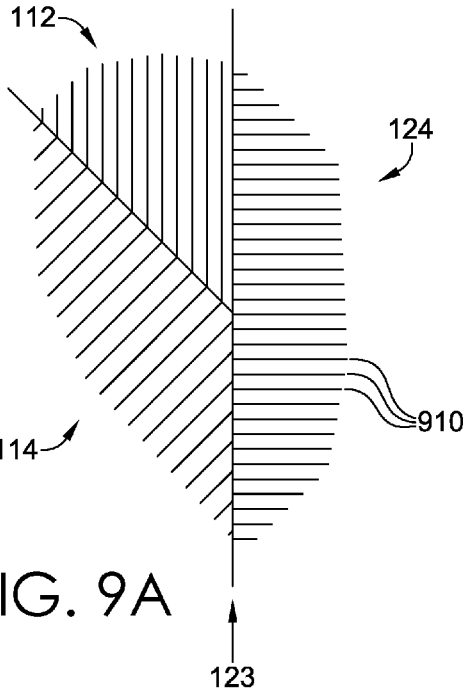
FIG. 9A illustrates a close-up view of an enhanced mobility side panel of an exemplary article of apparel before a vertical stretch force has been applied in accordance with an aspect herein.
Figure 9B:
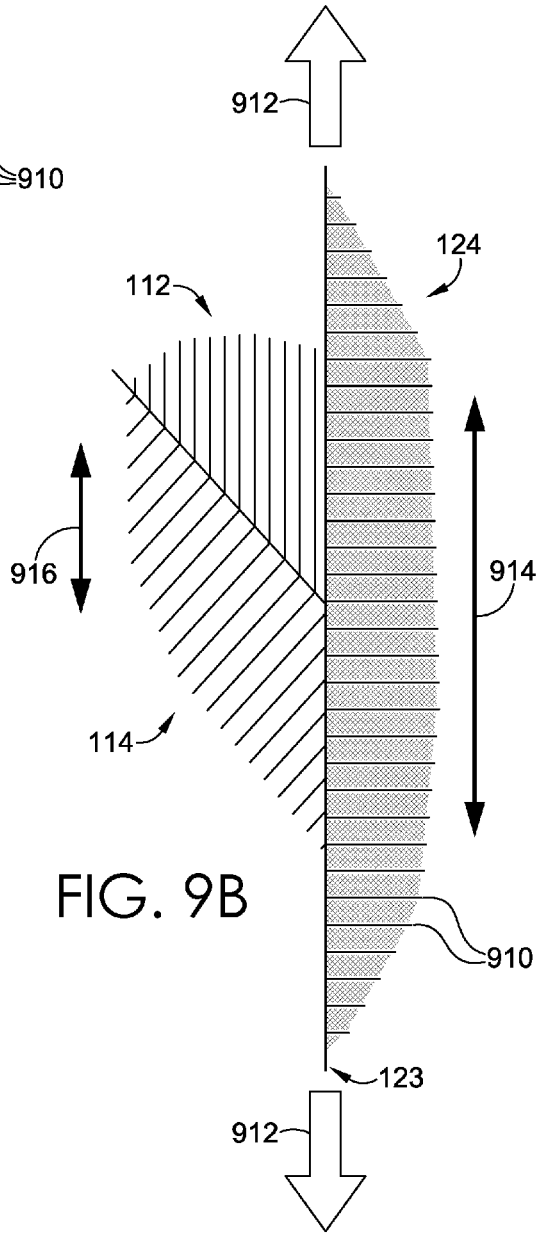
FIG. 9B illustrates a close-up view of the enhanced mobility side panel of FIG. 9A as a vertical stretch force is being applied in accordance with an aspect herein.

FIGS. 9A and 9B are close-up views of the intersection of the first and second portions 112 and 114 and the side panel 124 at the area indicated by the reference circle shown in FIG. 1. Although only one side panel 124 is depicted, the ensuing description is equally applicable to the other side panel 124. FIGS. 9A and 9B illustrate the different vertical stretch characteristics of the side panels 124 as compared to the first and second portions 112 and 114 of the back panel 110 when a vertical stretch force is applied to the article 100. Referring first to FIG. 9A, FIG. 9A illustrates the first portion 112, the second portion 114, and the side panel 124 of the back panel 110 in a resting state (i.e., before or after a vertical stretch force has been applied to the article 100). The first portion 112 is shown as a ribbed knit with the ribs oriented in a generally vertical direction, and the side panel 124 is also shown as a ribbed knit but with the ribs 910 oriented in a horizontal direction. Although a ribbed knit is depicted, it is contemplated that other stretch materials may be used herein. The second portion 114 is indicated by cross-hatching. The side panel 124 is shown as separated from the first and second portions 112 and 114 by the seam 123. The seam 123 may be an actual seam, or in cases where the first, second, and side panels 112, 114, and 124 are integrally knit from each other, the seam 123 may indicate a transition point from the vertical stretch characteristic associated with the first and second portions 112 and 114 to the vertical stretch characteristic of the side panel 124.

FIG. 9B illustrates the first portion 112, the second portion 114, and the side panel 124 as a vertical stretch force is applied to the article 100; the vertical stretch force is shown by the arrows 912. The vertical stretch force 912 may be applied, for instance, subsequent to a wearer of the article 100 reaching his or her arms upward such as above the wearer's head. This type of action by the wearer initiates the vertical stretch force 912 mainly along the side areas of the article of apparel 100. As shown in FIG. 9B, the vertical stretch force 912 causes the ribs 910 of the side panel 124 to pull apart or move in a vertical direction thereby accommodating the vertical stretch force 912. The amount of vertical stretch experienced by the side panel 124 is shown graphically by the length of the arrow 914. In an exemplary aspect, the material between the ribs 910—indicated by the cross-hatching in FIG. 9B—may have a different color than the ribs 910 and/or the other portions of the article 100. The result is a color reveal in the side panel 124 when the vertical stretch force 912 is applied to the article 900.

By contrast, because the first and second portions 112 and 114 generally do not experience as great of a vertical stretch force as the side panel 124 when the wearer raises his/her arms, the first and second portions 112 and 114 may be constructed to have a smaller vertical stretch characteristic as compared to the side panels 124. As shown in FIG. 9B, when the vertical stretch force 912 is applied to the article 100, the first and second portions 112 and 114 do not undergo as much vertical stretch as the side panel 124. This is shown graphically by the length of the arrow 916 in FIG. 9B. The result of the configuration of the first and second portions 112 and 114 and the side panel 124 is that the vertical stretch force 912 is accommodated by the side panel 124, and the article of apparel 100 retains its shape integrity for a longer period of time as compared to more typical constructions.

A method of manufacture for the article of apparel described herein may comprise the steps of preparing a front panel, such as the front panel 210 of FIG. 2, where the front panel is adapted to cover a front portion of the upper torso of the wearer when the article of apparel is in an as-worn configuration. The method may further comprise preparing a back panel, such as the back panel 110, of the article of apparel, where the back panel is adapted to cover a back portion of the upper torso of the wearer when the article of apparel is in the as-worn configuration. The back panel may comprise a first portion having a first lateral stretch characteristic that extends generally along an upper part of the back panel. The back panel may further comprise a second portion having a second lateral stretch characteristic that is less than the first lateral stretch characteristic, where the second portion is located adjacent to and below the first portion. In one exemplary aspect, the front panel is affixed to the back panel along at least a first side and a second side to form the article of apparel. The method of manufacture may further comprise affixing a first sleeve and a second sleeve to the article of apparel.

In another exemplary aspect, the method of manufacture for the article of apparel may further comprise preparing two side panels adapted to cover the wearer's sides when the article of apparel is in an as-worn configuration. The side panels have a vertical stretch characteristic that is greater than the first and second portions of the back panel. Instead of affixing the front panel to the back panel, the front and back panels may each be affixed to the side panels to form the article of apparel.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. An article of apparel having enhanced mobility portions for an upper torso of a wearer, the article of apparel comprising:

a front panel adapted to cover a front portion of the upper torso of the wearer when the article of apparel is in an as-worn configuration; and a back panel adapted to cover a back portion of the upper torso of the wearer when the article of apparel is in the as-worn configuration, the back panel affixed at least in part to the front panel to define at least a first arm opening and a second arm opening, the back panel comprising:

a first portion having a first lateral stretch characteristic, the first portion extending from a first location adjacent to a lower margin of the first arm opening, along an upper part of the back panel, and terminating at a second location adjacent to a lower margin of the second arm opening, and a second portion having a second lateral stretch characteristic, the second portion positioned adjacent to and extending inferiorly from the first portion when the article of apparel is in the as-worn configuration, the first lateral stretch characteristic being greater than the second lateral stretch characteristic, wherein a first area of the second portion comprises a double-layer material, and wherein a second area of the second portion comprises a single-layer material.

2. The article of apparel of claim 1, wherein the first portion is affixed to the second portion at one or more seams.

3. The article of apparel of claim 1, wherein the first portion is integrally knit with the second portion.

4. The article of apparel of claim 1, wherein the first area is located towards a lower margin of the back panel.

5. The article of apparel of claim 1, further comprising:

a first sleeve affixed to the first arm opening; and a second sleeve affixed to the second arm opening.

6. The article of apparel of claim 5, wherein the first sleeve and the second sleeve each comprise an upper arm portion adapted to cover the wearer's shoulder and upper arm area when the article of apparel is in the as-worn configuration, and a lower arm portion adapted to cover the wearer's elbow and lower arm area when the article of apparel is in the as-worn configuration.

7. The article of apparel of claim 6, wherein the upper arm portion of the each sleeve comprises a single-layer material, and wherein the lower arm portion of the each sleeve comprises a double-layer material.

8. The article of apparel of claim 1, further comprising:

a first side panel located at a first side of the article of apparel, wherein the first side panel has a first vertical stretch characteristic that is greater than a vertical stretch characteristic associated with the first and second portions of the article of apparel; and a second side panel located at a second side of the article of apparel, wherein the second side panel has a second vertical stretch characteristic that is greater than the vertical stretch characteristic associated with the first and second portions of the article of apparel.

9. The article of apparel of claim 8, wherein the first vertical stretch characteristic is the same as the second vertical stretch characteristic.

10. An article of apparel having enhanced mobility portions for an upper torso of a wearer, the article of apparel comprising:

a front panel adapted to cover a front portion of the upper torso of the wearer when the article of apparel is in an as-worn configuration; and a back panel adapted to cover a back portion of the upper torso of the wearer when the article of apparel is in the as-worn configuration, the back panel affixed at least in part to the front panel to define at least a first arm opening and a second arm opening, the back panel comprising at least a first, a second, and a third stretch zone, wherein:

the first stretch zone comprises a first material having a first lateral stretch characteristic, the first stretch zone located at an upper portion of the back panel, the second stretch zone comprises the first material and a second material, the second stretch zone having a second lateral stretch characteristic, the second stretch zone positioned adjacent to and extending inferiorly from the first stretch zone when the article of apparel is in the as-worn configuration, and the third stretch zone comprises the second material, the third stretch zone having a third lateral stretch characteristic, the third stretch zone located adjacent to and extending inferiorly from the second stretch zone when the article of apparel is in the as-worn configuration so that the second stretch zone is positioned between the first stretch zone and the third stretch zone, wherein, the first lateral stretch characteristic of the first stretch zone is greater than the second lateral stretch characteristic of the second stretch zone, and wherein the second lateral stretch characteristic of the second stretch zone is greater than the third lateral stretch characteristic of the third stretch zone.

11. The article of apparel of claim 10, wherein the first material is different than the second material.

12. The article of apparel of claim 10, wherein the first material is the same as the second material.

13. The article of apparel of claim 10, wherein the first material is configured as a panel having a central body portion and two arm portions extending in a downward direction from the central body portion.

14. The article of apparel of claim 13, wherein the central body portion of the panel is located in the first stretch zone, and wherein the two arm portions are located in the second stretch zone.

15. An article of apparel having enhanced mobility portions for an upper torso of a wearer, the article of apparel comprising:

a front panel adapted to cover a front portion of the upper torso of the wearer when the article of apparel is in an as-worn configuration;

a back panel adapted to cover a back portion of the upper torso of the wearer when the article of apparel is in the as-worn configuration, the back panel comprising:

a first portion having a first lateral stretch characteristic and a first vertical stretch characteristic, the first portion extending across at least an upper portion of the back panel, and a second portion having a second lateral stretch characteristic and a second vertical stretch characteristic, wherein the second lateral stretch characteristic is less than the first lateral stretch characteristic, the second portion positioned adjacent to and extending inferiorly from the first portion; and two side panels adapted to cover side portions of the upper torso of the wearer when the article of apparel is in the as-worn configuration, wherein the back panel is affixed to the front panel via at least the two side panels, the two side panels having a third vertical stretch characteristic that is greater than the first vertical stretch characteristic of the first portion of the back panel and the second vertical stretch characteristic of the second portion of the back panel.

16. The article of apparel of claim 15, wherein the two side panels have a third lateral stretch characteristic that is less than the first lateral stretch characteristic of the first portion of the back panel.

* * * * *